US010467836B1

(12) United States Patent
Kirchhausen

(10) Patent No.: US 10,467,836 B1
(45) Date of Patent: Nov. 5, 2019

(54) SMART STORAGE LOCKER FOR MOBILE DEVICES

(71) Applicant: Hans Kirchhausen, St. George, UT (US)

(72) Inventor: Hans Kirchhausen, St. George, UT (US)

( * ) Notice: Subject to any disclaimer, the term of this patent is extended or adjusted under 35 U.S.C. 154(b) by 0 days.

(21) Appl. No.: 16/206,757

(22) Filed: Nov. 30, 2018

(51) Int. Cl.
*G07C 9/00* (2006.01)
*A47B 81/00* (2006.01)
*E05B 65/02* (2006.01)

(52) U.S. Cl.
CPC ..... *G07C 9/00904* (2013.01); *A47B 81/00* (2013.01); *E05B 65/025* (2013.01)

(58) Field of Classification Search
CPC .. G07C 9/00904; G07C 9/00912; G07C 1/32; A47B 81/00; A47B 87/0284; E05B 65/025; G07F 17/12; H02J 2007/0001; H02J 7/0027
USPC ..... 340/5.73, 545.6; 320/106; 455/410, 411; 439/133, 134
See application file for complete search history.

(56) References Cited

U.S. PATENT DOCUMENTS 4,415,893 A * 11/1983 Roland ..... E05B 49/006 235/382
4,929,005 A * 5/1990 Heinen ..... H01F 38/14 292/251.5
5,744,933 A * 4/1998 Inoue ..... G06Q 20/127 320/110
8,904,198 B1 * 12/2014 Pinto ..... G07F 15/006 455/572
2003/0141840 A1 * 7/2003 Sanders ..... H02J 7/0027 320/107
2005/0104555 A1 * 5/2005 Simmonds-Short ..... H02J 7/0027 320/107
2009/0033456 A1 * 2/2009 Castillo ..... G07C 11/00 340/5.2
2010/0174629 A1 * 7/2010 Taylor ..... G06Q 20/10 705/34
2012/0078413 A1 * 3/2012 Baker, Jr. ..... G07F 17/12 700/232
2013/0132307 A1 * 5/2013 Phelps ..... H02J 7/0027 705/412
2014/0155100 A1 * 6/2014 Baldasare ..... H04M 1/72522 455/456.3
2014/0239883 A1 * 8/2014 Hobson ..... H02J 7/0027 320/107
2017/0323503 A1 * 11/2017 Garcia ..... G07C 9/00309

* cited by examiner

*Primary Examiner* — Edwin C Holloway, III
(74) *Attorney, Agent, or Firm* — David R. Conklin; Kirton McConkie

(57) ABSTRACT

A smart storage locker can be used to store an individual's mobile device while the individual is at work, school or another location where mobile devices should be restricted. The smart storage locker will therefore prevent the individual from carrying his or her mobile device while in such restricted environments. In addition to storing mobile devices, the smart storage locker can also be configured to automatically detect an individual's identity when the individual's mobile device is secured within the smart storage locker. This detection can then be employed to track when the individual is present at a particular location while not having access to, and therefore not using, his or her mobile device.

20 Claims, 7 Drawing Sheets

SMART STORAGE LOCKER FOR MOBILE DEVICES

BACKGROUND

Recent studies have revealed that a large percentage of individuals waste time each day at work. It is commonly believed that the use of mobile devices such as smart phones account for the majority of this wasted time. For example, many employees admit that they routinely use their mobile devices to check personal emails, browse social media networks, play mobile games or shop online during work. In fact, it is estimated that, on average, an employee may waste nearly eight hours a week doing non-work-related activities on his or her mobile device.

BRIEF SUMMARY

The present invention extends to a smart storage locker for mobile devices. The smart storage locker can be used to store an individual's mobile device while the individual is at work, school or another location where mobile devices should be restricted. The smart storage locker will therefore prevent the individual from carrying his or her mobile device while in such restricted environments. In addition to storing mobile devices, the smart storage locker can also be configured to automatically detect an individual's identity when the individual's mobile device is secured within the smart storage locker. This detection can then be employed to track when the individual is present at a particular location while not having access to, and therefore not using, his or her mobile device.

In one embodiment, the present invention is implemented as a storage locker that includes: an enclosure having an interior; a door that provides access to the interior; a connector positioned within the interior such that a mobile device contained in the interior can be connected to the connector; and a processing system that is connected to the connector via a plurality of wires. At least one of the wires passes through the door such that each of the wires that pass through the door is disconnected when the door is opened and connected when the door is closed.

In another embodiment, the present invention is implemented as a storage locker that includes: an enclosure having an interior; a door that provides access to the interior; a USB port positioned within the interior such that the USB port is inaccessible from outside the interior when the door is closed; and a processing system that is connected to the connector via a plurality of wires. At least one of the wires includes a terminal that is positioned on the enclosure and a corresponding terminal that is positioned on the door such that each of the at least one wires is disconnected when the door is opened and connected when the door is closed.

In another embodiment, the present invention is implemented as a storage locker that includes: an enclosure having an interior; a door that provides access to the interior; a connector positioned within the interior such that a mobile device contained in the interior can be connected to the connector; and a processing system that is connected to the connector via a plurality of wires. At least one of the wires passes through the door such that each of the wires that pass through the door is disconnected when the door is opened and connected when the door is closed. The processing system is configured to detect when a mobile device is connected to the connector while the door is closed and in response send a first notification to another system. The processing system is further configured to subsequently detect when the door has been opened and in response send a second notification to the other system.

This summary is provided to introduce a selection of concepts in a simplified form that are further described below in the Detailed Description. This Summary is not intended to identify key features or essential features of the claimed subject matter.

BRIEF DESCRIPTION OF THE DRAWINGS

Understanding that these drawings depict only typical embodiments of the invention and are not therefore to be considered limiting of its scope, the invention will be described and explained with additional specificity and detail through the use of the accompanying drawings in which.

DETAILED DESCRIPTION

In accordance with embodiments of the present invention, a smart storage locker can be configured to store an individual's mobile device to prevent the individual from carrying or otherwise accessing his or her mobile device. In conjunction with storing the individual's mobile device, the smart storage locker can also be configured to report the storage of the mobile device to another system to thereby enable the other system to track the presence of the individual. In this specification and the claims, the term "mobile device" should be construed as encompassing smart phones, portable media players and other personal electronic devices that individuals may carry on their person.

Figure 1A:
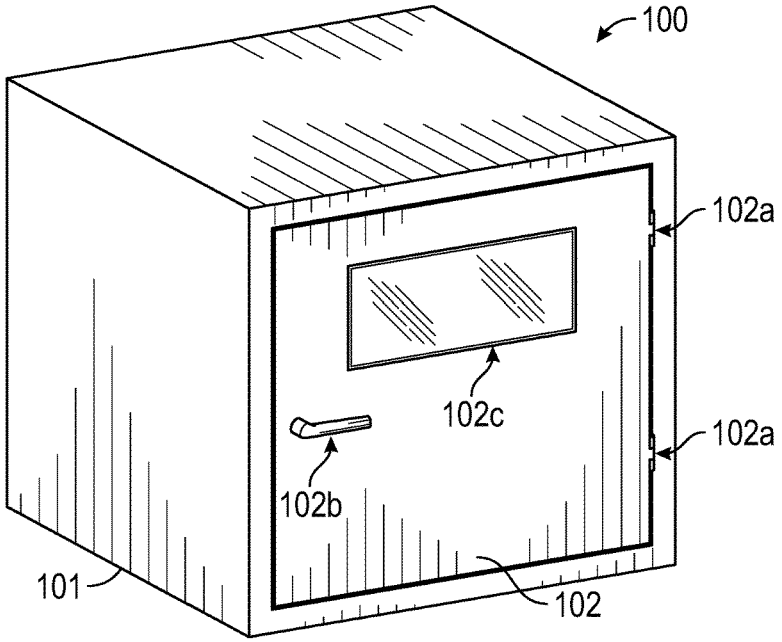
FIG. 1A illustrates an example embodiment of a smart storage locker with the door closed.
Figure 1B:
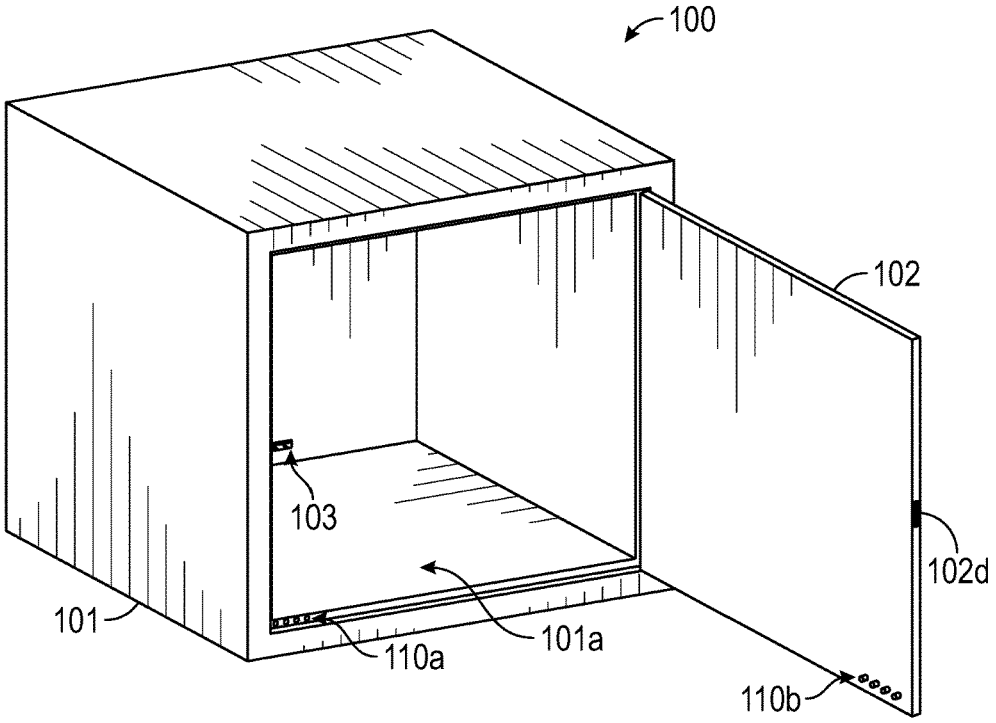
FIG. 1B illustrates the smart storage locker of FIG. 1A with the door opened.

FIGS. 1A and 1B illustrate an example of a smart storage locker 100 that is configured in accordance with one or more embodiments of the present invention. Locker 100 forms an enclosure 101 that includes a door 102 that can be locked to secure a mobile device within locker 100. Door 102 can be connected to enclosure 101 via hinges 102*a* to enable door 102 to swing between the closed position shown in FIG. 1A and the open position shown in FIG. 1B. Door 102 can also include a handle 102*b* to facilitate opening, a display 102*c* on which information can be displayed and/or input can be received, and a lock 102*d* to prevent unauthorized individuals from accessing a mobile device stored in locker 100.

As shown in FIG. 1B, locker 100 can form an enclosed interior 101*a* within which a USB port 103 is located. In the depicted embodiment, USB port 103 is contained within the rear wall of locker 100; however, a USB port could be contained at any other location within interior 101*a*. Also, although USB port 103 is shown as a USB Type-A port, any other type of USB port (e.g., a USB Type-C port) or a port that adheres to a protocol standard that replaces USB could be used. Furthermore, in some embodiments, one or more USB cables could be contained within interior 101*a* in place of or in addition to USB port 103. Therefore, in this specification and the claims, the term "connector" should be construed as a physical interface by which a mobile device can be connected to a processing system that is integrated into or otherwise connected to locker 100.

As is also shown in FIG. 1B, enclosure 101 can include a set of terminals 110*a* while door 102 can include a corresponding set of terminals 110*b*. Although not shown, a first cable can extend from USB port 103 to terminals 110*a* while a second cable can extend from terminals 110*b* to a processing system that may be contained within the walls of enclosure 101 or otherwise connected to locker 100. For example, the second cable could be routed through one of hinges 102*a* and into a sidewall or floor of locker 100 to connect to a processing system contained therein.

In the specification and the claims, the term "processing system" will be used to represent any type of computing system that is capable of performing the functionality described herein. For example, a processing system could be in the form of a Windows, Linux or other operating-system-based personal computer, a specialized microprocessor, an application-specific integrated circuit (ASIC), etc. As indicated above, the processing system could be entirely contained within locker 100, or locker 100 could include a connector by which the second cable is connected, whether directly or indirectly, to an external processing system.

In the depicted embodiment, since USB port 103 is a Type-A port, there will be four wires that connect USB port 103 to the processing system. Therefore, each set of terminals 110*a*/110*b* includes four terminals—one for each wire of the USB Type-A cable. Of course, in embodiments that employ a different type of port, each set of terminals 110*a*/110*b* can include a number of terminals corresponding to the number of wires in the particular type of port. In this specification and the claims, the term "wire" should be construed to encompass any medium by which an electric signal can be conveyed between two endpoints.

Terminals 110*a* and 110*b* are positioned and configured so that corresponding pairs of terminals form an electrical connection when door 102 is closed. In other words, each wire of USB port 103 will only be electrically coupled to the processing system when door 102 is closed. Therefore, even if a mobile device is physically connected to USB port 103, an electrical connection will not be established between the processing system and the mobile device until door 102 is closed.

FIG. 1B represents embodiments where each wire of USB port 103 is routed through door 102. However, in other embodiments, only one or some of the wires may be routed through door 102 while the remaining wires may be connected directly to the processing system. For example, it may only be necessary to route the VCC and/or ground wire(s) (e.g., pins 1 and/or 4 of the USB Type-A connector) through door 102 since the data wires (e.g., pins 2 and 3 of the USB Type-A connector) will not function without power. In embodiments where locker 100 may include more than one USB port or multiple charging cables (e.g., a micro USB cable, a USB Type-C cable, an Apple Lighting cable, etc.), the power wires for each port/cable could be routed through the same terminal pair given that each type of cable operates off the same voltage (i.e., 5 volts). This would reduce the number of terminals that need to be employed. In short, locker 100 can include sets of terminals 110*a*/110*b* that function as a switch on at least one wire of each connector contained within interior 101*a*.

Figure 3A:
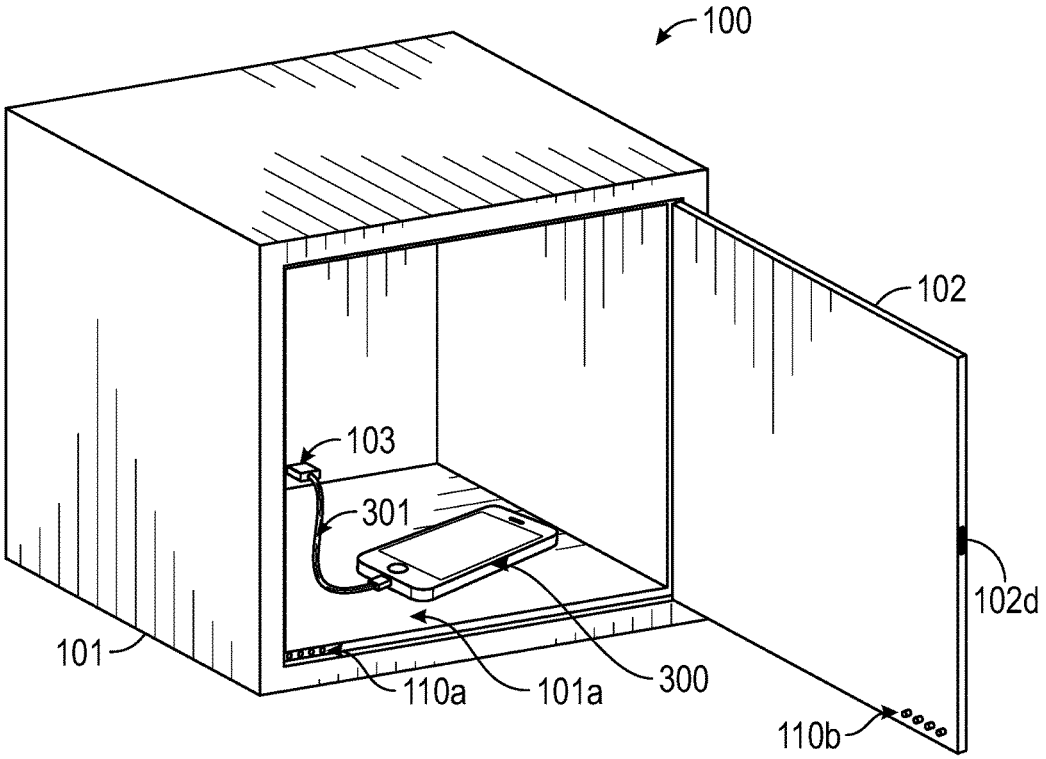
FIG. 3A illustrates how a mobile device can be connected to a USB port within the smart storage locker.

As introduced above, the reason for this routing of at least one of the wires that connect USB port 103 to the processing system is to prevent USB port 103 from becoming functional until door 102 is closed. For example, in the depicted embodiment, an individual may open door 102 and connect his or her mobile device to USB port 103 using a suitable charging cable such as is shown in FIG. 3A. While door 102 remains open, however, USB port 103 will remain physically disconnected from the processing system (or at least unpowered if only a power wire or wires are routed through door 102) thereby preventing the processing system from detecting the mobile device. Then, once the individual closes door 102, terminals 110*b* will contact terminals 110*a* thereby connecting USB port 103 to the processing system. This will not only enable the mobile device to be charged but will also enable the processing system to communicate with the mobile device. For example, as shown in FIG. 3B, display 102*c* can be updated using information obtained from the mobile device to reflect whose mobile device is contained in locker 100.

Figure 2:
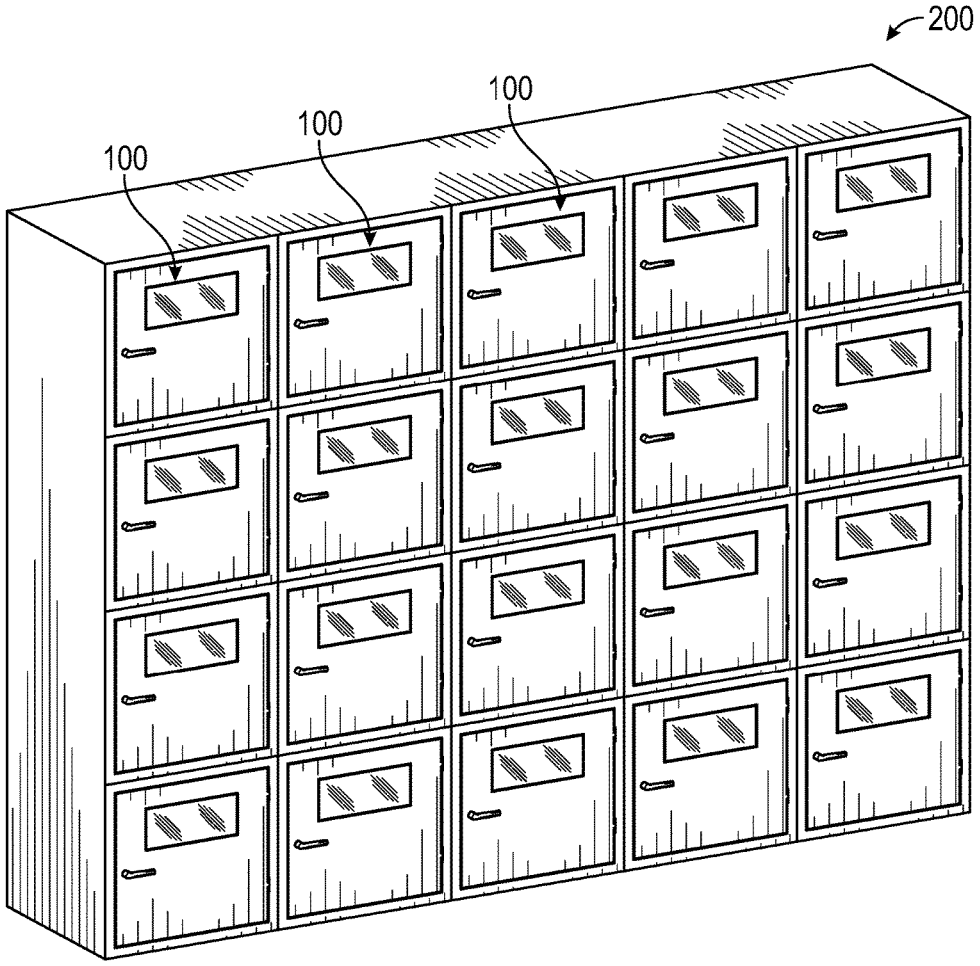
FIG. 2 illustrates an example of how a number of smart storage lockers can be arranged.

Notably, while door 102 is closed, the individual will not have access to the mobile device. Additionally, because USB port 103 is connected to the processing system through door 102, the processing system will be able to immediately detect when the individual opens door 102 to again obtain access to the mobile device. Locker 100 therefore provides a way to track the presence of an individual at a particular location while the individual does not have access to his or her mobile device. Further, locker 100 provides a way to track the time an individual accesses or refrains from accessing his or her mobile device. As shown in FIG. 2, a number of lockers 100 can be arranged into a locker module 200 to enable many individuals to store their mobile devices when at a particular location. For example, a company may provide a locker module 200 for its employees to store their mobile devices while at work.

FIG. 4A-4D illustrate a sequence of functional steps that a processing system 150 can perform when a mobile device is stored in locker 100. These functional steps will be described in the context of FIGS. 3A and 3B. As indicated above, processing system 150 could be incorporated into or external to locker 100. In either case, however, door 102 will function as a switch on the connection between processing system 150 and USB port 103. For purposes of this example, it will be assumed that processing system 150 is connected to the internet via a wired or wireless connection which enables processing system 150 to communicate with a server 400. However, processing system 150 could be connected to server 400 via a local area network connection, a Bluetooth connection, or any other type of connection.

Figure 3B:
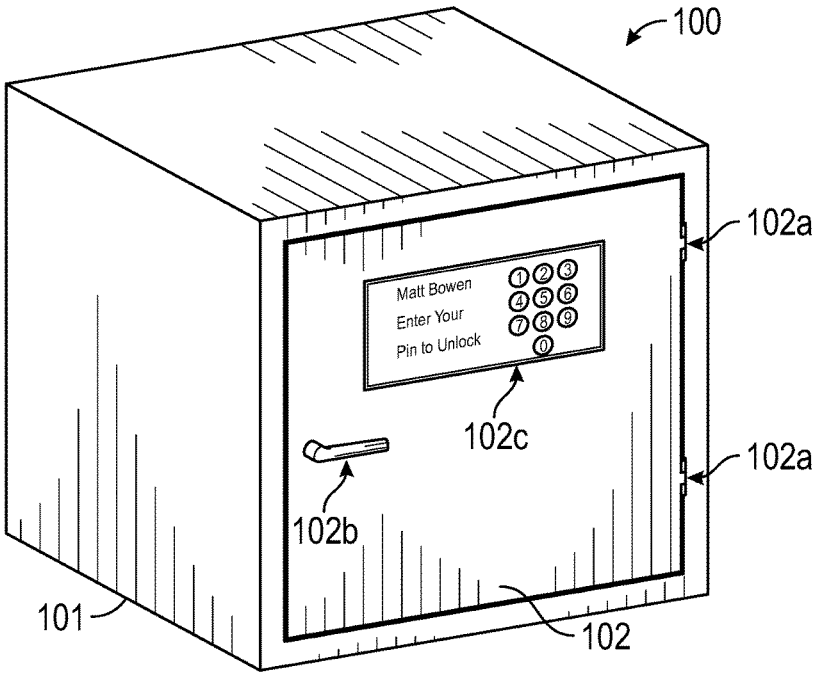
FIG. 3B illustrates how a display can be updated when a mobile device is stored within the smart storage locker.

With reference to FIGS. 3A and 3B, it will be assumed that an individual named Matt Bowen has placed his mobile device 300 in locker 100, connected it to USB port 103 via cable 301 and shut door 102. As described above, once door 102 is closed, each of terminals 110*b* will contact a corresponding one of terminals 110*a* so that USB port 103 becomes powered and connected to processing system 150. Processing system 150 can be configured to implement a standard USB subsystem such that this connection of USB port 103 will cause mobile device 300 to be enumerated on processing system 150 (e.g., via plug-and-play functionality). As is known, this enumeration will result in processing system 150 loading suitable drivers to enable processing system 150 (e.g., an application on processing system 150) to communicate with mobile device 300.

Figure 4A:
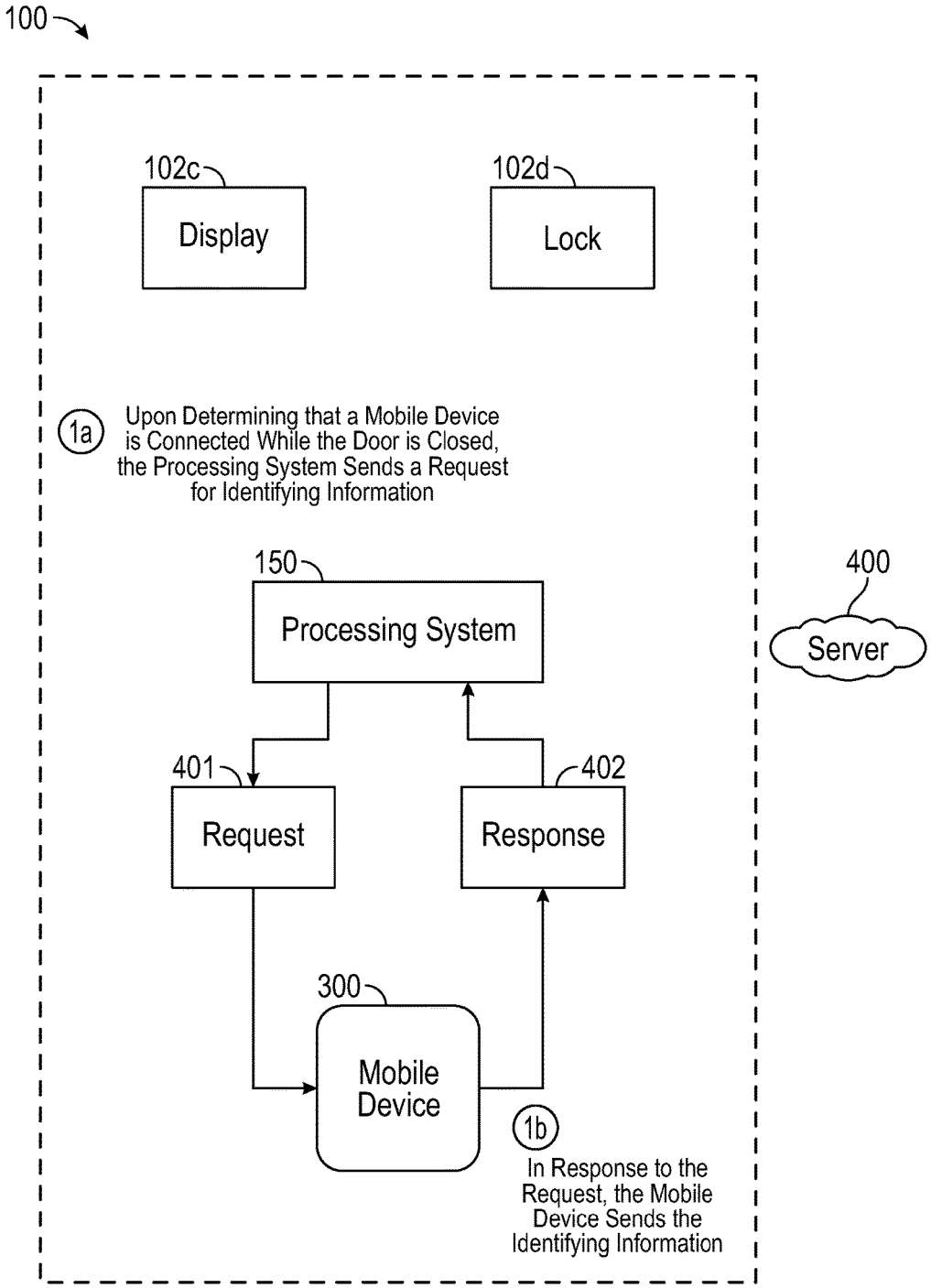
FIGS. 4A-4D illustrate a sequence of steps that the smart storage locker can perform to track when a mobile device is stored.

At this point, and as represented in step 1*a* of FIG. 4A, processing system 150 can send a request 401 to mobile device 300 to retrieve identifying information. This identifying information can be any information that identifies mobile device 300. In some embodiments, request 401 can be a request for mobile device 300's USB device descriptor. In step 1*b*, mobile device 300 will send a response 402 that includes the requested identifying information. For example, when request 401 is in the form of a request for the USB device descriptor, response 402 can include mobile device 300's device descriptor which would include a vendor ID, product ID and serial number of mobile device 300 among other information. For example, if mobile device 300 is a Google Pixel 2, response 402 could include a vendor ID of 18D1, a product ID of 4EE1 and a serial number of HT93G1A01945.

To enable processing system 150 to identify an individual from his or her mobile device's identifying information, an account can be created for each individual that is authorized to store a mobile device is locker 100. For example, prior to storing mobile device 300 in locker 100, Matt Bowen (or an administrator) could create an account that associates his name with the vendor ID, product ID and serial number of mobile device 300. Processing system 150 can then be provided access to such accounts for use when individuals store their mobile devices in locker 100. For example, processing system 150 can include a local database or have access to a remote database where the accounts are stored.

In some embodiments, processing system 150 can be configured to present an option for an individual to create an account upon storing a mobile device in locker 100. For example, if processing system 150 receives identifying information from a mobile device stored in locker 100 and the identifying information is not associated with any account, processing system 150 can use display 102*c* to prompt the individual to create an account. Alternatively, processing system 150 may record and store the storage information of the mobile device (i.e., the initial time the mobile device was stored in locker 100, the duration of storage, and the time the mobile device was removed from locker 100), which may be subsequently claimed by the individual through creating an account.

Regardless of how an account is created, each account can associate identifying information of one or more mobile devices with a particular individual. Each account can also include credentials for unlocking locker 100. For example, an individual can create a pin, password, biometric information, etc. to be used to authenticate the individual for the purpose of unlocking locker 100 when the individual's mobile device is stored therein.

Figure 4B:
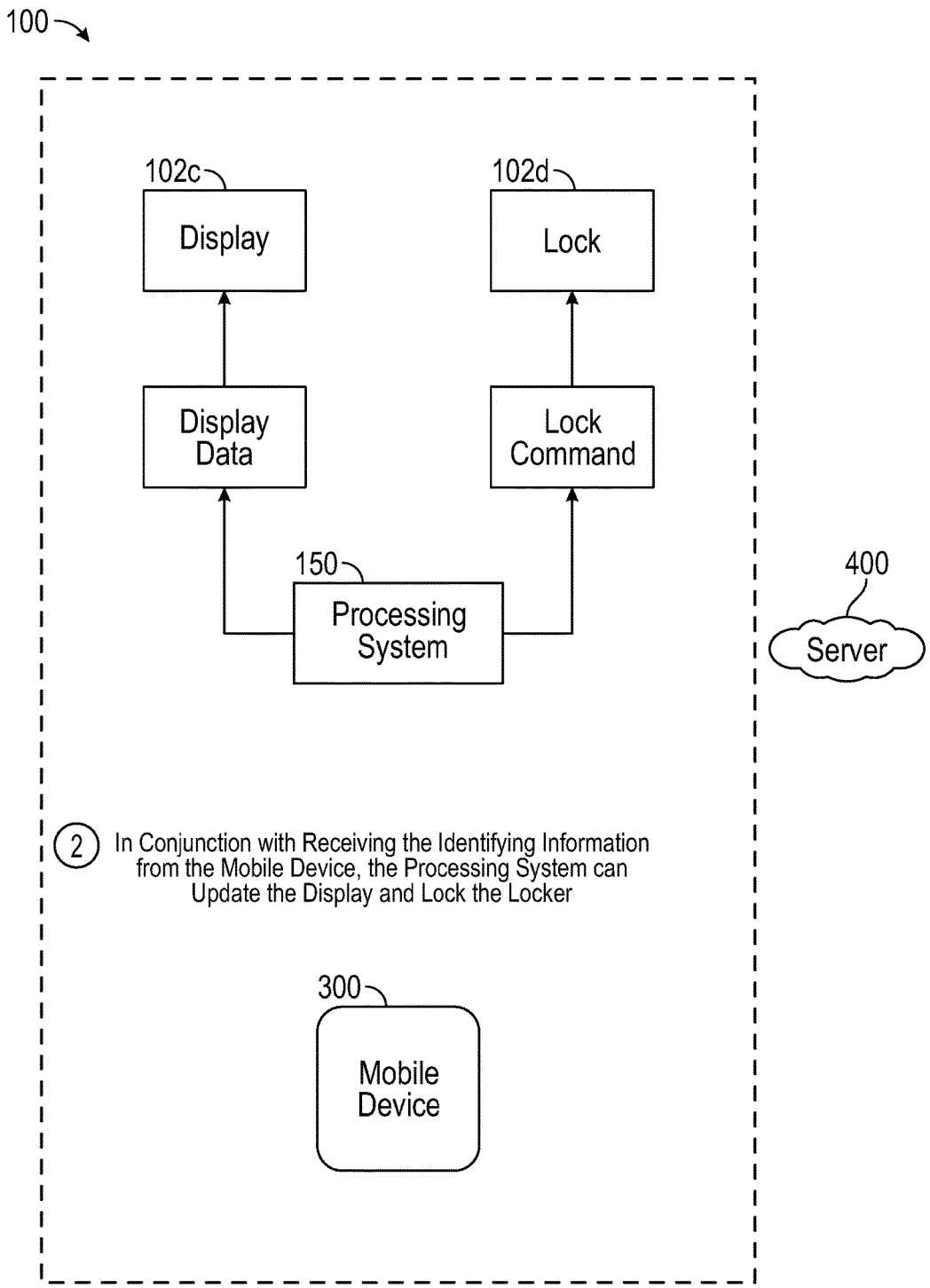

With reference to FIG. 4B, once processing system 150 has received identifying information from mobile device 300 and has identified an individual using the identifying information, in step 2, processing system 150 can send display data to update display 102*c* and can send a lock command to lock 102*d* to thereby secure mobile device 300 within locker 100. As represented in FIG. 3B, this display data can cause display 102*c* to present the name of the individual (Matt Bowen) that is associated with the identifying information retrieved from mobile device 300. The display data may also provide a keypad or other user interface by which Matt Bowen can input a pin or other credentials to unlock locker 100. Of course, locker 100 may alternatively or additionally include other types of input devices such as a hardware keypad or keyboard, a biometric scanner (e.g., a fingerprint reader or iris scanner), a voice recognition system, etc.

Figure 4C:
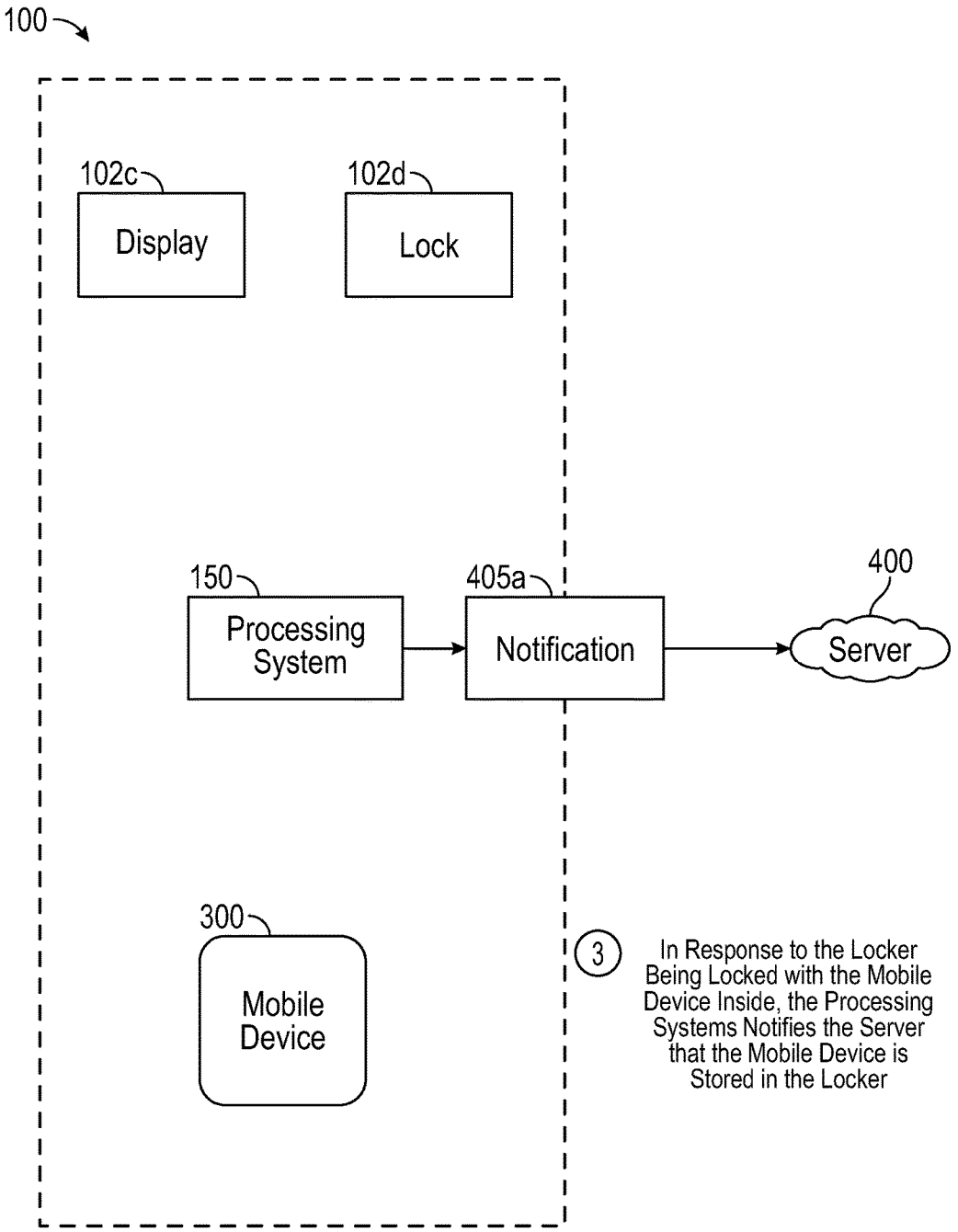

In step 3 shown in FIG. 4C, processing system 150 can also send a notification 405*a* to server 400 to notify server 400 that Matt Bowen has locked his mobile device 300 in locker 100. Server 400 can represent many different types of systems including, for example, a time keeping system. In such cases, notification 405*a* can function as a clock-in request. In this way, an employer can ensure that Matt Bowen is not considered clocked in unless his mobile device is locked in locker 100. In another example, server 400 can represent an automobile's control module or other electronic system that controls the automobile's ignition. In such cases, notification 405*a* can function as an indication that Matt Bowen does not have access to his or her mobile device. In this way, the automobile can be configured to start only after Matt Bowen's mobile device is locked in locker 100.

Figure 4D:
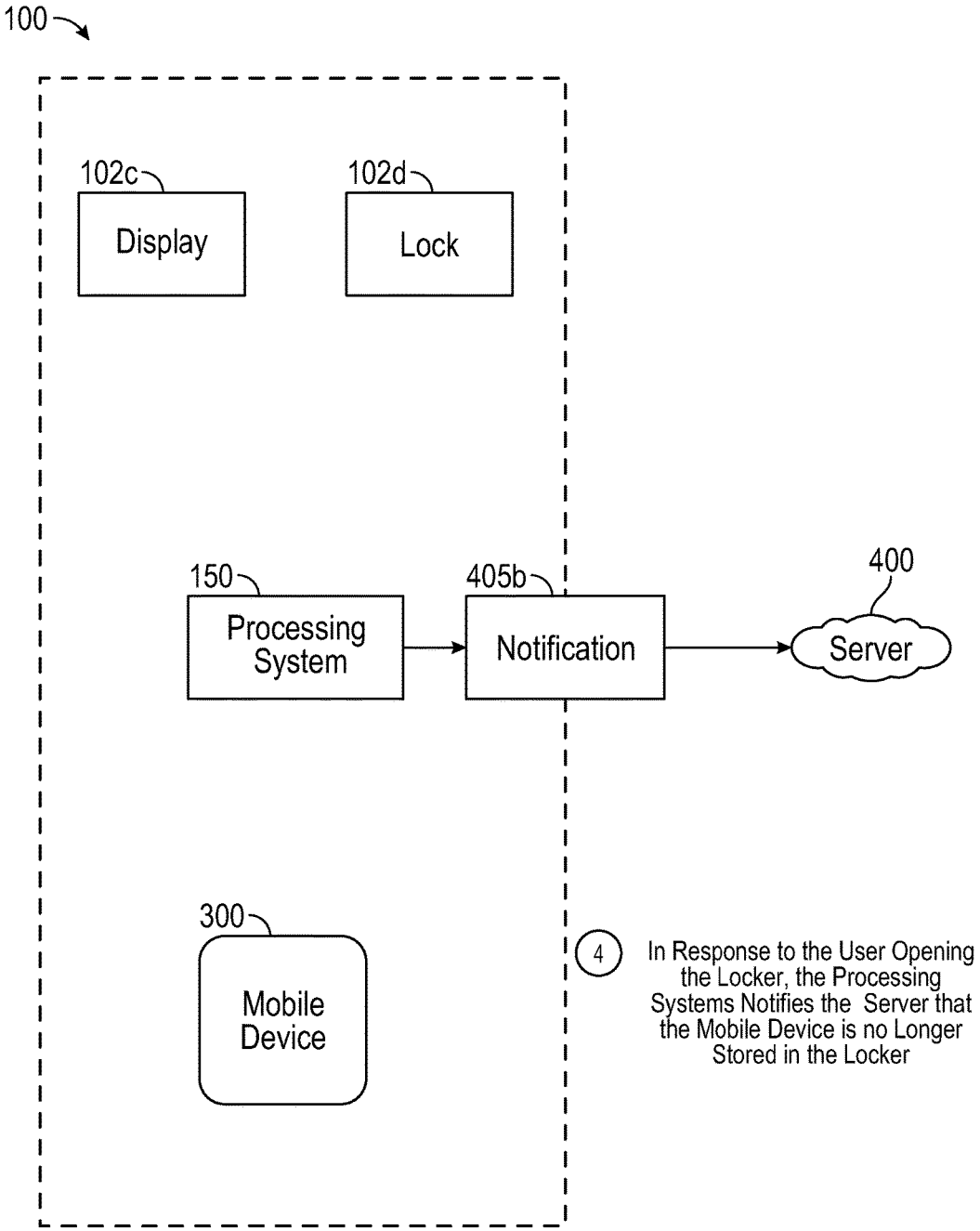

Finally, as represented in step 4 shown in FIG. 4D, when Matt Bowen provides the proper credentials to unlock lock 102*d* and open door 102, processing system 150 will detect the disconnection of mobile device 300 that occurs as door 102 is opened and can send a notification 405*b* to server 400. Notification 405*b* can indicate that Matt Bowen has again obtained access to mobile device 300. As an example, when server 400 represents a time keeping system, notification 405*b* can function as a clock-out request.

These steps can be repeated each time an individual locks his or her mobile device in locker 100 and then retrieves it. In the context of a time keeping system, an individual would therefore clock in by locking his or her mobile device in locker 100 and clock out by retrieving the mobile device. This could be done at the beginning and end of the workday as well as for each break an employee may take during the workday. In this way, an employer can utilize locker 100 to not only identify the presence of employees, but to also minimize the likelihood that employees will waste time on their mobile devices while at work. At the same time, employees can benefit from the elimination of the distractions that mobile devices create while also charging their mobile devices.

Although the examples given above have assumed that a single mobile device is stored in locker 100, in some embodiments, locker 100 can be configured to store multiple mobile devices at the same time. For example, a locker could include multiple USB ports or multiple charging cables. In such embodiments, an individual's account could include identifying information for multiple mobile devices, and processing system 150 could be configured to require each of the individual's mobile devices to be locked inside locker 100 before sending notification 405*a*.

In summary, a locker configured in accordance with embodiments of the present invention can couple a USB port or other connector to a processing system via the locker's door so that a mobile device connected to the USB port will be detected only when the door is closed. The processing system can be configured to detect the identity of an individual from information obtained from a mobile device locked within the locker. The processing system can also report the individual's identity in conjunction with the closing and opening of the locker's door to a server or other system.

In the above described embodiments, a locker has been employed to provide a secure environment for storing mobile devices. However, in other embodiments, the locker can be replaced with a storage cube or other storage unit that does not include a door. In such embodiments, the presence of a mobile device and the identity of the user of the mobile device can be detected in much the same manner—i.e., by querying the mobile device for identifying information when the mobile device is connected to a USB port or other connector within the storage cube. In such cases, the USB port can always be powered such that the connection of the mobile device alone triggers the detection of the user's identity. However, in other embodiments, a pressure pad or other weight activated sensor within the storage unit can function to connect the USB port to processing system 150 only when a mobile device is placed thereon. Such pressure pad embodiments could be employed even with lockers having doors. In other words, the door, a pressure activated switch or another type of switch that is activated when a mobile device is placed in a storage unit can be used to selectively connect a USB port within the storage unit to processing system 150.

In some embodiments, the presence of a mobile device and the identity of its user can be detected without requiring the mobile device to be physically coupled to a connector within a locker, cube or other storage unit (generally "storage unit"). For example, in some embodiments, processing system 150 can be configured to associate a particular user with a particular storage unit such that, whenever any mobile device is detected within the particular storage unit, processing system 150 will presume that the user associated with that particular storage unit is present.

To accomplish this detection without the phone being physically connected, the storage unit may include a wireless charger, and processing system 150 may be configured to detect when a device is being charged via the wireless charger (e.g., by sensing when current is being drawn at a particular storage unit). Alternatively, the storage unit may include a pressure pad or other weight activated sensor that allows processing system 150 to detect when a mobile device or another object is placed in a storage unit. In other embodiments, each storage unit could be configured with an RFID, Bluetooth, NFC or other close range wireless protocol reader that is configured to retrieve identifying information from a mobile device that is placed within the storage unit.

As one example only, a storage cube could be used in a school environment as a means for taking role. In such cases, the storage cube can include a cube for each student and processing system 150 can be configured to detect whether an object, such as a mobile device, is stored in the cubes. Because some students may not have a mobile device that they can store in their cube to report their presence, each cube can include a pressure pad that detects the presence of an object within the cube. For any student that does not have a mobile device, an object similar in weight to a mobile device can be provided. Accordingly, each student can place his or her mobile device or the provided object into his or her cube as a way to represent that the student is present in the classroom or other environment. Processing system 150 can then be configured to detect which cubes contain objects and take role accordingly.

The present invention may be embodied in other specific forms without departing from its spirit or essential characteristics. The described embodiments are to be considered in all respects only as illustrative and not restrictive. The scope of the invention is, therefore, indicated by the appended claims rather than by the foregoing description.

What is claimed is:

1. A storage locker comprising:

an enclosure having an interior;

a door that provides access to the interior;

a connector positioned within the interior such that, while the door is open, a mobile device can be placed in the interior and connected to the connector; and a processing system that is selectively connected to the connector via a plurality of wires, at least one of the wires passing through the door to cause the connector to be connected to the processing system when the door is closed but to become disconnected from the processing system when the door is open such that the closing of the door causes the connector to commence receiving power via the plurality of wires and to provide the power to the mobile device that is placed in the interior of the enclosure and connected to the connector;

wherein, in response to the connector providing the power to the mobile device, the processing system uses the plurality of wires to retrieve identifying information from the mobile device.

2. The storage locker of claim 1, wherein the connector is a USB port.

3. The storage locker of claim 1, wherein each of the plurality of wires passes through the door.

4. The storage locker of claim 1, wherein the plurality of wires comprises four wires.

5. The storage locker of claim 1, wherein each of the at least one wires that passes through the door comprises a terminal that is positioned on the enclosure and a corresponding terminal that is positioned on the door.

6. The storage locker of claim 1, wherein the at least one of the wires that passes through the door comprises wires that carry power for the connector, and wherein wires that carry data do not pass through the door.

7. The storage locker of claim 1, wherein the processing system is configured to detect when a mobile device is connected to the connector while the door is closed and to then retrieve identifying information from the mobile device.

8. The storage locker of claim 7, wherein the identifying information comprises a USB device descriptor of the mobile device.

9. The storage locker of claim 1, wherein the identifying information from the mobile device identifies an individual using the mobile device.

10. The storage locker of claim 9, further comprising:

a display;

wherein the processing system is configured to update the display based on the identifying information.

11. The storage locker of claim 10, wherein updating the display comprises causing a name of the individual to be displayed.

12. The storage locker of claim 9, wherein the processing system is configured to lock the door in conjunction with identifying the individual.

13. The storage locker of claim 12, wherein the processing system is configured to unlock the door upon receiving credentials from the individual.

14. The storage locker of claim 9, wherein, in response to identifying the individual using the identifying information of the mobile device, the processing system is configured to send a first notification to another system, the first notification representing that the individual has placed the mobile device in the storage locker and closed the door.

15. The storage locker of claim 14, wherein, in response to detecting that the door has been opened, the processing system is configured to send a second notification to the other system, the second notification representing that the individual has opened the door to access the mobile device.

16. A storage locker comprising:

an enclosure having an interior;

a door that provides access to the interior;

a USB port positioned within the interior such that the USB port is inaccessible from outside the interior when the door is closed; and a processing system that is selectively connected to the USB port via a plurality of wires, at least one of the wires including a terminal that is positioned on the enclosure and a corresponding terminal that is positioned on the door to cause the USB port to be connected to the processing system when the door is closed but to become disconnected from the processing system when the door is open such that the closing of the door causes the USB port to commence receiving power via the plurality of wires whereby the USB port is readied to power a mobile device that is placed in the interior of the enclosure and connected to the USB port;

wherein, in response to the USB port receiving power, the processing system uses the plurality of wires and the USB port to retrieve identifying information from a mobile device connected to the USB port.

17. The storage locker of claim 16, wherein the processing system is configured to request a USB device descriptor from a mobile device connected to the USB port while the door is closed.

18. The storage locker of claim 17, wherein the processing system is configured to identify an individual using the USB device descriptor.

19. A storage locker comprising:

an enclosure having an interior;

a door that provides access to the interior;

a connector positioned within the interior such that a mobile device contained in the interior can be connected to the connector; and a processing system that is connected to the connector via a plurality of wires, at least one of the wires passing through the door such that each of the at least one wires is disconnected when the door is opened and connected when the door is closed;

wherein the processing system is configured to perform steps for:

detecting when a mobile device is connected to the processing system via the connector;

retrieving information from the mobile device;

identifying an individual from the information retrieved from the mobile device;

detecting a closed position of the door;

detecting an open position of the door;

recording a first time at which the door is closed and a second time at which the closed door is opened; and tracking a duration of time the individual refrains from accessing the mobile device, wherein the duration of time is equal to a difference between the first time and the second time.

20. The storage locker of claim 19, wherein the processing system is further configured to perform at least one additional step for:

tracking the presence of the individual at a particular location over the duration of time; and assigning a time credit to the individual equal to the duration of time;

wherein the time credit is selected from the group consisting of a duration of work as an employee, a duration of attendance in a classroom, and a duration of undistracted driving.

* * * * *